US010246792B2

(12) United States Patent
Ida

(10) Patent No.: US 10,246,792 B2
(45) Date of Patent: Apr. 2, 2019

(54) ROTOR FOR POLISHING HOLLOW TUBES

(71) Applicant: MARUI GALVANIZING CO., LTD., Hyogo (JP)

(72) Inventor: Yoshiaki Ida, Hyogo (JP)

(73) Assignee: Marui Galvanizing Co., Ltd., Hyogo (JP)

( * ) Notice: Subject to any disclaimer, the term of this patent is extended or adjusted under 35 U.S.C. 154(b) by 168 days.

(21) Appl. No.: 15/513,824

(22) PCT Filed: Oct. 8, 2015

(86) PCT No.: PCT/JP2015/078581

§ 371 (c)(1),
(2) Date: Mar. 23, 2017

(87) PCT Pub. No.: WO2016/056620

PCT Pub. Date: Apr. 14, 2016

(65) Prior Publication Data

US 2017/0292203 A1 Oct. 12, 2017

(30) Foreign Application Priority Data

Oct. 10, 2014 (JP) ..... 2014-208611
Mar. 25, 2015 (JP) ..... 2015-062577

(51) Int. Cl.
*C25D 7/04* (2006.01)
*C25F 3/16* (2006.01)
(Continued)

(52) U.S. Cl.
CPC ..... *C25F 3/16* (2013.01); *C25F 3/26* (2013.01); *C25F 7/00* (2013.01); *C25F 7/02* (2013.01);
(Continued)

(58) Field of Classification Search
CPC ..... C25F 3/16; C25F 3/26; C25F 7/00; H05H 7/20; C25D 7/04; C25D 17/007
See application file for complete search history.

(56) References Cited

U.S. PATENT DOCUMENTS 3,827,950 A 8/1974 Diepers et al.
9,674,936 B2 * 6/2017 Hara ..... C25F 3/26
2015/0159294 A1 6/2015 Ida

FOREIGN PATENT DOCUMENTS

JP 55-12116 3/1980
JP 61-23799 2/1986
(Continued)

OTHER PUBLICATIONS

International Preliminary Report on Patentability dated Apr. 11, 2017 in corresponding International (PCT) Application No. PCT/JP2015/078581.

(Continued)

*Primary Examiner* — Nicholas A Smith
(74) *Attorney, Agent, or Firm* — Wenderoth, Lind & Ponack, L.L.P.

(57) ABSTRACT

A rotor for polishing hollow tubes, in which an outer tube is slidable over an inner tube and is provided with at least one window in the wall. At the window on the inner tube, a plate vane is fixed at the base end to an auxiliary shaft arranged perpendicular to the main shaft so as to be able to rotationally move. A link bar is arranged in the main shaft direction to extend between the outer tube and the plate vane. The rotor is able to transition between an initial state (plate vane closed) and an operational state (plate vane open) by the inner tube moving relative to the outer tube. An electrode for electropolishing or a buff for mechanical polishing is fixed to the tip end of the plate vane. This allows for adjustment of the position of the plate vane and control of the polished state.

10 Claims, 13 Drawing Sheets

(51) Int. Cl.

| | |
|---|---|
| ***C25F 3/26*** | (2006.01) |
| ***C25F 7/00*** | (2006.01) |
| ***C25F 7/02*** | (2006.01) |
| ***H05H 7/20*** | (2006.01) |
| ***H05H 7/22*** | (2006.01) |
| ***C25D 17/00*** | (2006.01) |

(52) U.S. Cl.
CPC ..... *H05H 7/20* (2013.01); *C25D 7/04* (2013.01); *C25D 17/007* (2013.01); *H05H 7/22* (2013.01)

(56) References Cited

FOREIGN PATENT DOCUMENTS

| | | |
|---|---|---|
| JP | 11-350200 | 12/1999 |
| JP | 2000-71164 | 3/2000 |
| WO | 2014/010540 | 1/2014 |

OTHER PUBLICATIONS

International Search Report dated Dec. 22, 2015 in International (PCT) Application No. PCT/JP2015/078581.

* cited by examiner 120
120

110
110w
110w
Welding 110
110s
110w

Welding
Partial Polishing

100

Inner Surface Polishing

ROTOR FOR POLISHING HOLLOW TUBES

TECHNICAL FIELD

The present invention relates to a rotor for electropolishing an internal surface of a hollow tube.

BACKGROUND ART

A linear collider will be constructed as an apparatus for creating a state of Big Bang by the collision of positrons and electrons (International Linear Collider Project). The linear collider uses a hollow tube 100 made of niobium, which is provided with flanges 101*a* and 101*b* at both ends, and has a diameter changing periodically in an axial direction, as shown in FIG. 13. There are requirements to obtain a predetermined effect in this experiment, and one requirement is that the internal surface of the niobium hollow tube 100 is to be smooth.

The hollow tube 100, however, is subjected to an excessive pressure and heat at the formation, so that a texture of an internal surface becomes distorted non-uniformly. If this surface status is left alone, the electric properties and the magnetic properties become uneven, too, with the result that it is impossible to impart a predetermined speed to the electrons and the positrons. Therefore, methods for polishing the internal surface of the hollow tube in a predetermined thickness have been developed as a countermeasure against such problem.

As the polishing method for the niobium hollow tube, there are three kinds of polishing methods, namely, a method for polishing chemically (hereinafter referred to a "chemical polishing"), a method for polishing electrochemically (hereinafter referred to an "electropolishing"), and the mechanical polishing such as the buff polishing.

With respect to the electropolishing, there are following examples.

Japanese Examined Patent Application Publication No. 55-12116 discloses an intermittent electropolishing wherein, the niobium hollow tube is placed keeping both openings in horizontal, a lower half part of the niobium hollow tube is partially immersed in the polishing liquid composed of the fluoric acid, the sulfuric acid and the water. While maintaining the partial immersion, the partial electropolishing is performed by turning on the power for a short time. And after the electricity went off, the tube is rotated to dissolve and remove an oxide film. These steps are executed repeatedly.

In the above-mentioned method, the outer surface of the hollow tube not to be polished is polished at the same time that the internal surface is polished, as a result, the unnecessary dissolving loss of the hollow tube occurs and the polishing liquid is consumed unnecessarily and contaminated. Moreover, the polishing unevenness occurs due to the intermittent polishing, and the operation is very dangerous because of handling the fluoric acid that is high volatile and produces toxic gas, and the sulfuric acid that is a high pyrogenic substance.

The invention disclosed in Japanese Unexamined Patent Application Publication No. 61-23799 is configured to perform the continuous electrolysis in the state of the partial immersion by supplying the polishing liquid from nozzles connected with a liquid feed pipe while rotating the niobium hollow tube. In this configuration, the polishing time can be reduced and the unnecessary dissolution of the niobium member can be eliminated, and therefore, it is possible to suppress the unnecessary contamination and consumption of the polishing liquid.

However, since it is configured that the nozzles provided to the liquid feed pipe are opened in the polishing liquid and the polishing liquid is discharged into the stored polishing liquid, the difference between the flow velociities of the polishing liquid appears in the state of the polishing, and the unevenness of the polished appearance occurs on the internal surface of the niobium hollow tube, which is a problem, too.

The invention disclosed in Japanese Unexamined Patent Application Publication No. 11-350200 is the basically same as Japanese Unexamined Patent Application Publication No. 61-23799, but the nozzles provided to the liquid feed pipe is configure to be opened toward an upper side of the polishing liquid, the side opposite to the side to be polished, so as not to flow the polishing liquid direct into the stored polishing liquid. According such configuration, the invention realizes the uniform polishing.

The applicant of the present invention suggested the electrode for the electropolishing in International Patent Application No. PCT/JP2013/68593; wherein the wing electrode configured by plural wings corresponding to respective bulge shapes of the hollow tube is rotated in the hollow tube. Such wing electrode is configured to be able to transition between a state with the plate vane closed (stored state) and a state with the plate vane open (operational state), and to attach to and remove from the hollow tube provided with periodical bulges.

As the mechanical polishing, Japanese Unexamined Patent Application Publication No. 2000-071164 discloses the polishing method that revolves the hollow tube while rotating the hollow tube after adding the abrasive grain in the hollow tube 100.

CITATION LIST

Patent Literature 1: Japanese Examined Patent Application Publication No. 55-12116

Patent Literature 2: Japanese Unexamined Patent Application Publication No. 61-23799

Patent Literature 3: Japanese Unexamined Patent Application Publication No. 11-350200

Patent Literature 4: International Patent Application No. PCT/JP2013/68593

Patent Literature 5: Japanese Unexamined Patent Application Publication No. 2000-71164

DISCLOSURE OF THE INVENTION

Problems to be Solved by the Invention

In the electropolishing methods of the above patent literature 1 to 3, however, the liquid feed pipe, that is a cathode, is in a linear shape, and regarding the internal surface of the hollow tube that is an object to be polished, the diameter varies in the wave pattern form as described above. Therefore, distances between each part of the internal surface of the hollow tube and the cathode are not homogeneous. The current gathers at a part which has a short distance. When the part having a large distance is polished in a predetermined thickness, an enormous time is required for the polishing and the cost increases.

In addition, in the electropolishing methods of the above patent literature 1 to 3, it is configured that the hollow tube is placed in horizontal and the polishing liquid is stored in the lower part of the tube, and then the polishing is performed. At this time, a cavity is left in a part above the polishing liquid, and the bubbles generated from the polishing liquid, such as hydrogen fluoride, stays at this part temporarily. There is a possibility that, as the polishing progresses, the polished surface deteriorates owing to the generated bubbles.

In the technique disclosed in Japanese unexamined patent application publication No. 11-650200, the hollow tube is placed in vertical when it is set up and filled with the polishing liquid, while the tube is placed horizontally when the polishing is performed, and then the tube is placed in vertical again when the disposal liquid is discharged. The operation becomes complicated very much.

The disclosure in the International Patent Application No. PCT/JP2013/68593 is configured to ensure the polishing homogeneity since the wing has a shape corresponding to the internal shape of the hollow tube, and it is possible to perform the polishing with higher accuracy than the above-mentioned three methods. Due to the bubbles generated in the tube, however, the polishing thickness tends to be increased at the upper side of the bulge rather than the lower side of the bulge.

The mechanical polishing method disclosed in Japanese Unexamined Patent Application Publication No. 2000-71164 is configured to applying both the revolution and the rotation. Where the diameter of the tube to be polished varies in the axis direction, the method cannot deal with the change of the diameter so that the finished result of the polishing becomes changes every part. Specifically, in case of the hollow tube used to the linear collider, the polished condition of the bulge part having a large diameter is not sufficient. The applicant of the present invention suggested, in Japanese patent application No. 2013-198073, the method and the tool for polishing the small diameter parts before finishing the hollow tube. Even if using the technique disclosed therein, the other operation is left for polishing the internal surface of the large diameter parts (welded parts) of the hollow tube after being assembled.

The present invention has an object to provide with the rotor for the mechanical polishing capable of polishing the internal surface of the hollow tube uniformly.

Means of Solving the Problems

The present invention relates to a rotor for polishing an inner surface of the hollow tube, and employs the following configuration.

An outer tube is inserted slidably over an inner tube. At least one window is provided to a peripheral wall of the outer tube. A base end of the plate vane is fixed on the inner tube at a position corresponding to the window so as to move rotatably around an auxiliary shaft perpendicular to a main shaft (a common shaft to the inner tube and the outer tube). A link bar is arranged in the main shaft direction to connect the outer tube with the plate vane, the plate vane can be moved from an initial state of closing the plate vane to an operational state of opening the plate vane by relatively sliding the inner tube and the outer tube in the main shaft direction.

According to the above configuration, the plate vane is further provided with an electrode on the tip of the plate vane, whereby the electropolishing can be performed in the operational state. In addition, the plate vane is configured so that an opening angle of the plate vane can be adjusted in the inside of the hollow tube, except for the horizontal state.

When the electropolishing is performed after covering all the rotor with an insulating mesh or fabric cover, the bubbles are discharged from a bubbles vent hole to the outside without damages the hollow tube.

Furthermore, the plate vane is provided with a buff on the tip of the plate vane, and the tip of the buff can be configured to contact with the inner surface of a large diameter portion of the hollow tube in the operational state.

Effects of the Invention

When the plate vane is provided with the electrode at the tip of the plate vane and in the operational state of opening the plate vane in the horizontal direction, the large diameter portion of the hollow tube can be polished and the oxides caused by the welding and the welding flux at this portion can be removed. Additionally, since the opening angle of the plate vane is adjusted inside the hollow tube, all the inner surface of the hollow tube can be electropolished.

It is configured that the plate vane is provided with the buff at the tip of the plate vane and the portion at the top of the bulge of the hollow tube (the welded portion) contact with the buff, so that this portion can be subjected to the buff-polishing. In the same manner as the electropolishing described above, the oxides caused by the welding and the welding flux at this portion can be removed.

BEST MODE FOR CARRYING OUT THE INVENTION

<Process of Forming a Hollow Tube>

Figure 13:
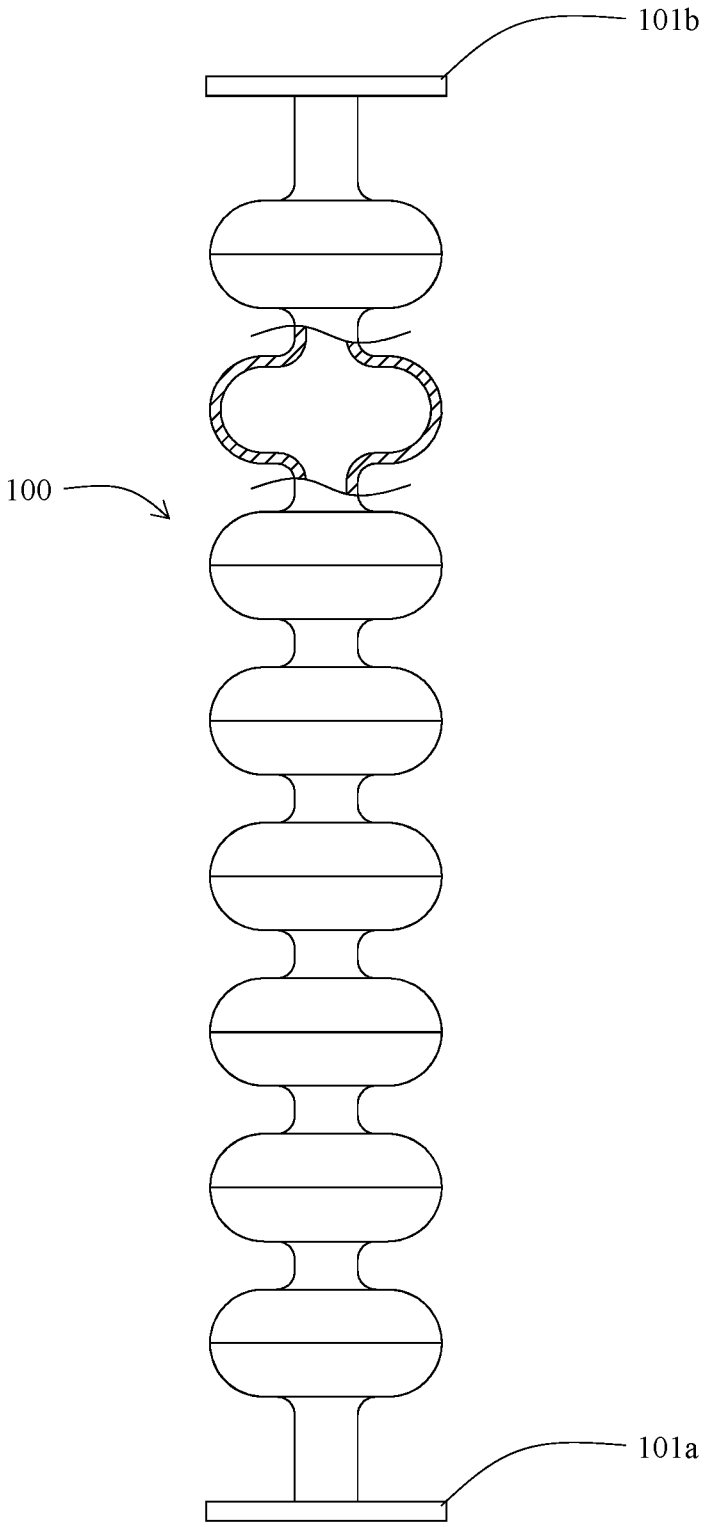
FIG. 13 is a side view of the hollow tube to which the present invention is applied.

The object to be polished in the present invention is a hollow tube such as tube bodies, and specifically the hollow tube of which diameter changes periodically in an axial direction shown in FIG. 13, (wherein bulges are arranged periodically). It is very important to polish large diameter parts of the hollow tube (innermost parts of the bulges), and the reason is related to the forming process of the hollow tube.

Figures 12A, 12B, 12C, 12D, 12E, 12F:
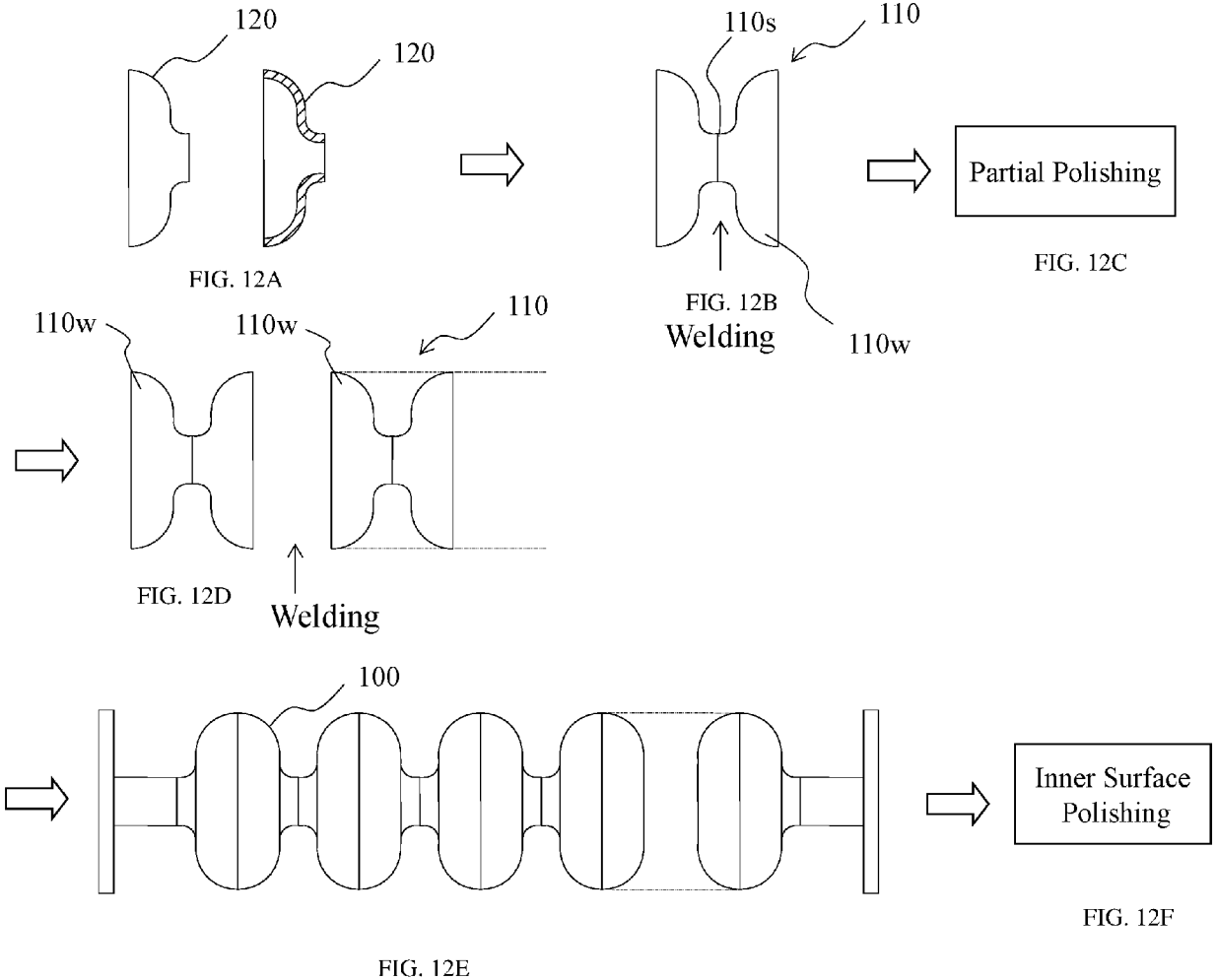
FIGS. 12A-12F indicate the process of forming the hollow tube.

In the forming process of the hollow tube, first of all, a dumbbell-like part 110 is formed by welding small diameter parts 110*s* of cup-like parts 120 mutually, as shown in FIGS. 12(*a*) to 12(*b*). Next, at this time, the inner surfaces of the small diameter parts 110*s* is subjected to the ectropolishing (FIG. 12C). In addition, as shown in FIGS 12D-12E, the hollow tube 100 is formed by welding mutually large diameter parts 110*w* of the dumbbell-like part 110. Accordingly, the oxides or the oxidized flux caused by the welding remain on the inner surface nearby a bulge top (the large diameter part). Therefore, polishing this part becomes important.

<Structure 1 of the Rotor for the Electropolishing>

Figure 1:
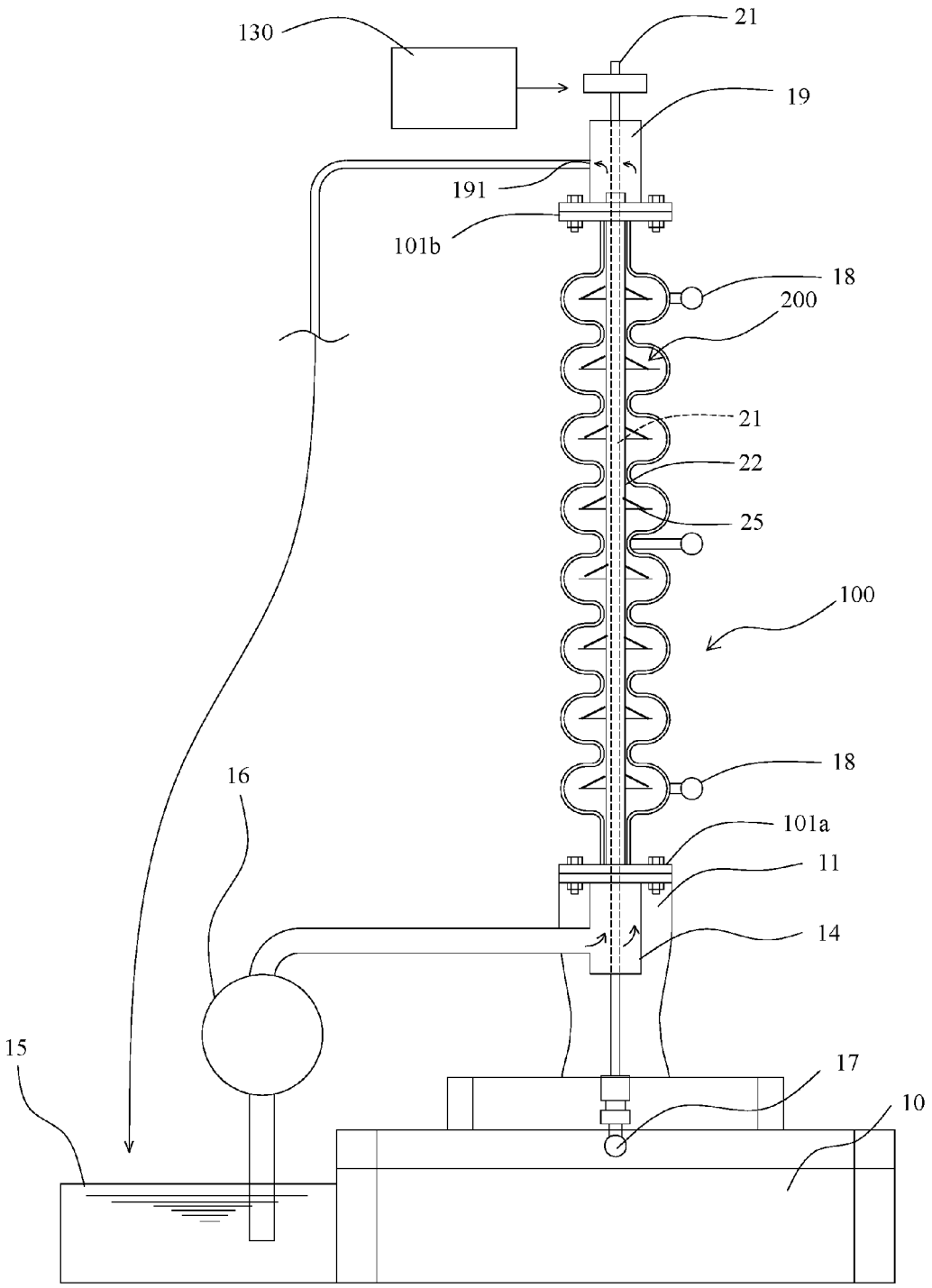
FIG. 1 is a side view showing a use state of the present invention.
Figure 2:
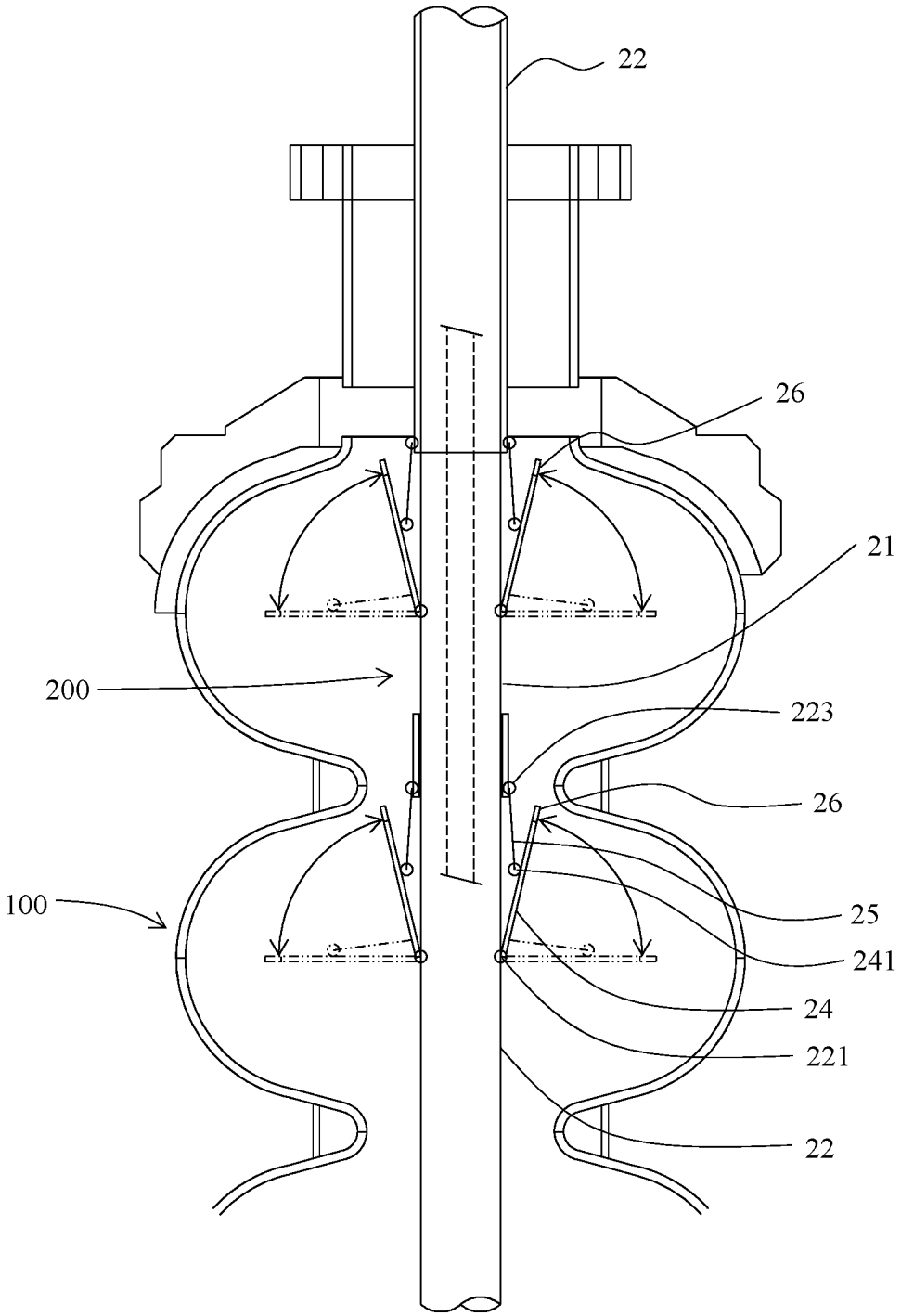
FIG. 2 is a sectional side view showing a structure of the rotor for the electropolishing.
Figure 3:
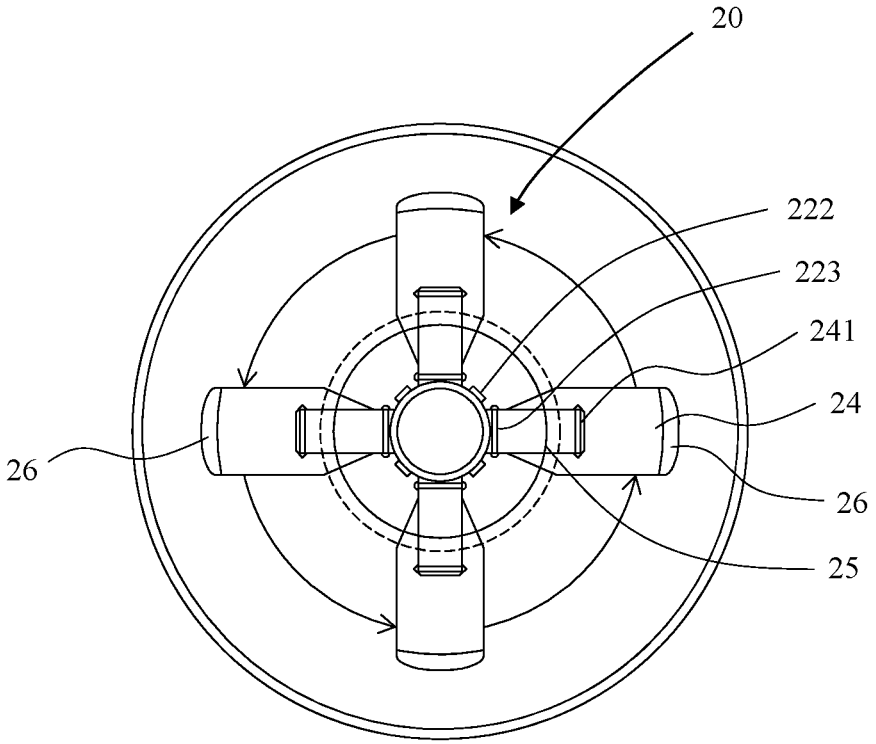
FIG. 3 is a horizontal sectional view showing a structure of the rotor for the electropolishing.
Figure 4:
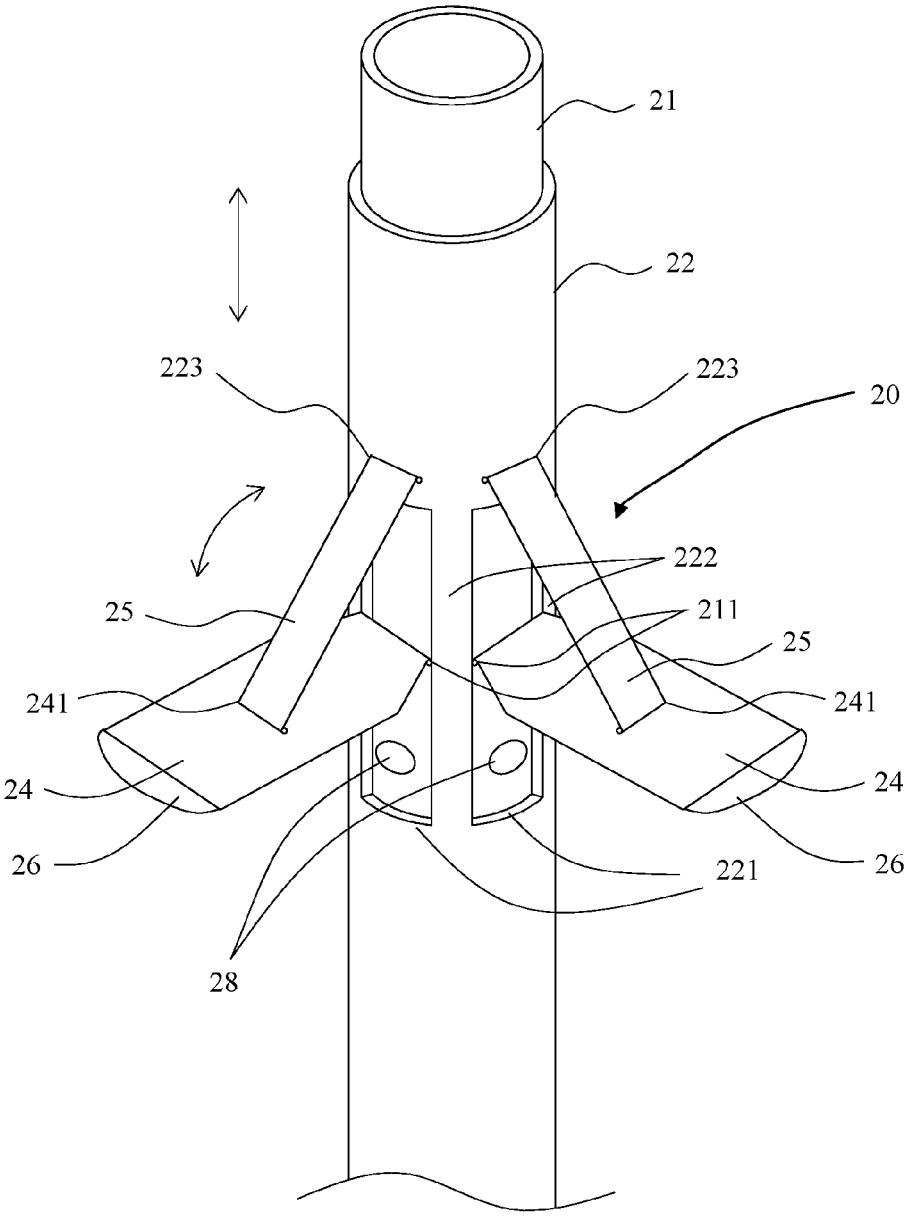
FIG. 4 is a perspective view showing a structure of the rotor for the electropolishing.

FIG. 1 shows a state of electropolishing the inside part of the hollow tube by means of the rotor in accordance with the present invention, FIG. 2 is a sectional side view showing the rotor in accordance with the present invention along with the hollow tube to be polished, and FIG. 3 is a horizontal sectional view thereof. FIG. 4 is a perspective view showing a main part of the rotor in accordance with the present invention.

The rotor including an inner tube and an outer tubes and plate vanes as main elements is configured as follows.

An outer tube 22 is slidably inserted over an inner tube 21 in a main shaft direction. Besides, a common shaft to both the inner tube 21 and the outer tube 22 is referred to the main shaft hereinafter. The outer tube 22 is provided with one or a plurality of windows 221; the window in a specific size corresponding to each bulge of the hollow tube 100, and the plurality of the windows 221 being arranged at even intervals in the circumferential direction. A surface of the inner tube 21 corresponding to the window 221 appears on the outside, and the outer tube 22 continues up and down thorough window flames 222 in the main shaft direction between the adjacent windows 221.

At the position corresponding to the window 221, an end of the plate vane 24 is fixed to an auxiliary shaft 211 arranged in a direction perpendicular to the main shaft of the inner tube 21 (in a tangential direction of the circumference) as to move rotationally. A link bar 25 extends between a vicinity of a center of the upper surface of the plate vane and an upper portion of the widow 221 of the outer tube 22, and it is supported by the auxiliary shafts 241 and 223 perpendicular to the main shaft. In addition, an electrode 26 is fixed to a tip of the plate vane 24.

According to the above-mentioned configuration, the inner tube 21 relatively slides over the outer tube 22 in the main shaft direction, so that the plate vane 24 changes the form between an initial state and an operational state described hereinafter.

When the outer tube 22 is pulled up from the inner tube 21 as much as possible and the plate vane 24 opens upwards maximally, it is defined as the initial state (a straight line in FIG. 2). Next, the outer tube 22 is gradually pulled down to the inner tube 21, and the angle between the plate vane 24 and the main shaft gradually widen and becomes a right angle, namely the plate vane indicates a horizontal direction, so that the operational state (a broken line in FIG. 2, FIG. 3 and FIG. 4) is formed.

As describe above, it is very important for the present invention to polish the oxides or the fluxes formed or attached on the inner surface nearby the top of the bulge (the large diameter part) due to the welding. Accordingly, the present invention requires keeping the state that the plate vane 24 turns to the horizontal direction, and keeping a short distance between the electrode 26 attached at the tip of the plate vane 24 and the inner surface of the hollow tube 100 enough to perform the undermentioned electropolishing.

In the present invention, one or a plurality of plate vanes 24 is arranged at even intervals in the circumferential direction so as to correspond to each bulge of the hollow tube. There are four windows 221 in FIG. 2, FIG. 3 and FIG. 4, and therefore four plate vanes are arranged at even intervals in the circumferential direction, whereby a plate vane unit 20 corresponding to each bulge of the hollow tube is formed.

Since the hollow tube 100 has a plurality of bulges periodically in the main shaft direction as shown in FIG. 1 or FIG. 13, the structure of the plate vane unit 20 is to correspond to the number of the bulges and the positions thereof. FIG. 2 shows only the plate vane unit 20 corresponds to the uppermost bulge and next one shown in FIG. 1. And the rotor 200 is constituted of the same number of the plate vane units 20 as the number of the bulges of the hollow tube.

The shape of the plate vane 24 constituting the plate vane unit 20 can vary according to the usage, but when the object to be polished is subjected to the electropolishing as described hereinafter, it is enough that an end surface of the electrode 26 is a metal and the plate vane is a plate metal or an insulating plate. In this case, needless to say that the electric continuity is ensure between the electrode 26 and the outer tube 22 or the inner tube 21 so as to supply the necessary electric power to the end surface of the electrode 26.

<Electropolishing>

The rotor 20 configured as above is mounted to the hollow tube 100 as shown in FIG. 1, and the inner surface of the hollow tube is electropolished, of which process is describe hereinafter.

FIG. 1 is a side view showing a device for polishing the inner surface of the hollow tube 100 using the rotor 200 configured as above.

A stand 11 is placed on a base 10, a liquid entrance room 14 is provided under a center of the stand 11. The polishing liquid is supplied from a polishing liquid tank 15 to the liquid entrance room 14 through a pump 16, and the polishing liquid is introduced to the inside of the hollow tube 100 placed on the stand 11 through the liquid entrance room 14.

The hollow tube 100, which is an object to be polished, is fixed on the stand 11 by a flange 101*a*. Under such condition, the rotor 200 in the initial state is inserted therein from an upper end of the hollow tube 100. At this time, the inner tube 21 of the rotor 200 rotatably and liquid-tightly goes through the hollow tube to a part under the liquid entrance room 14, of which the bottom end is provided with a connector 17 connecting with a lead. Besides, since the hollow tube 100 is long in vertical, a support frame 18 for fixing the hollow tube 100 is supported by a prop not shown in figure in order to stabilize the tube on the stand 11.

Next, a liquid exit room 19 is fixed on the other flange 101*b* of the hollow tube 100. At this time, it is configured that the inner tube 21 (or both the inner tube 21 and the outer tube 22) projects rotatably and liquid-tightly above the upper end of the liquid exit room 19, and the inner tube 21 slides over the outer tube 22. According to such configuration, the plate vane 24 can be changed from the initial state to the operational state by a manual operation or an automatic operation.

Since there is other variations than the above-mentioned structure regarding the setting structure of the hollow tube 100 and the installation structure of the rotor 200, the further explanation is omitted here, but the above-mentioned inserted rotor 200 is configured so as to rotate against the hollow tube 100 when the rotational force is given to the inner tube 21 (or the outer tube 22) projecting upwardly as described above. At this time, the rotational force may be given by a driving unit 120 so as to rotate the plate vane 24 at a specific speed during the electrolysis processing.

Under such structure, it is configured that the polishing liquid is introduced at a specific flow velocity from the liquid entrance room 14 to the hollow tube 100 by the liquid supply pomp 16, and then the polishing liquid turns back to the polishing liquid tank 15 from the liquid exit room 19. In addition, the plate vane 24 are changed to the operational state by sliding the inner tube 21 out of the outer tube 22. Under such condition, the electric field is applied between the hollow tube 100 and the electrode 26 at the tip of the plate vane 24, and the inner tube 21 rotates slowly together with the outer tube 22 (for example, 50 rotations per minute), whereby the inner surface of the hollow tube 100 can be polished. In particular, since the electrode 26 is the closest to the top of the bulge of the hollow tube (the welded part) during the operational state, the welding oxide at this part or the oxide of the flux used at the welding can be removed.

Since the various conditions such as the flow rate of the electrolyte and the intensity of the electric field are not the subject matter of the present invention, the detailed explanation is omitted here.

When the polishing is finished as described above, the polishing liquid is discharged (from a drain (not shown) provided to the liquid entrance room 14), and the washing water is supplied from the liquid supply pomp 16 to the hollow tube 100, and the hollow tube 100 is washed. After that, the rotor 200 is changed to the initial state and then extracted from the hollow tube 100, whereby the operation is completed.

<Rotor Structure 2 for Electropolishing>

Figure 5:
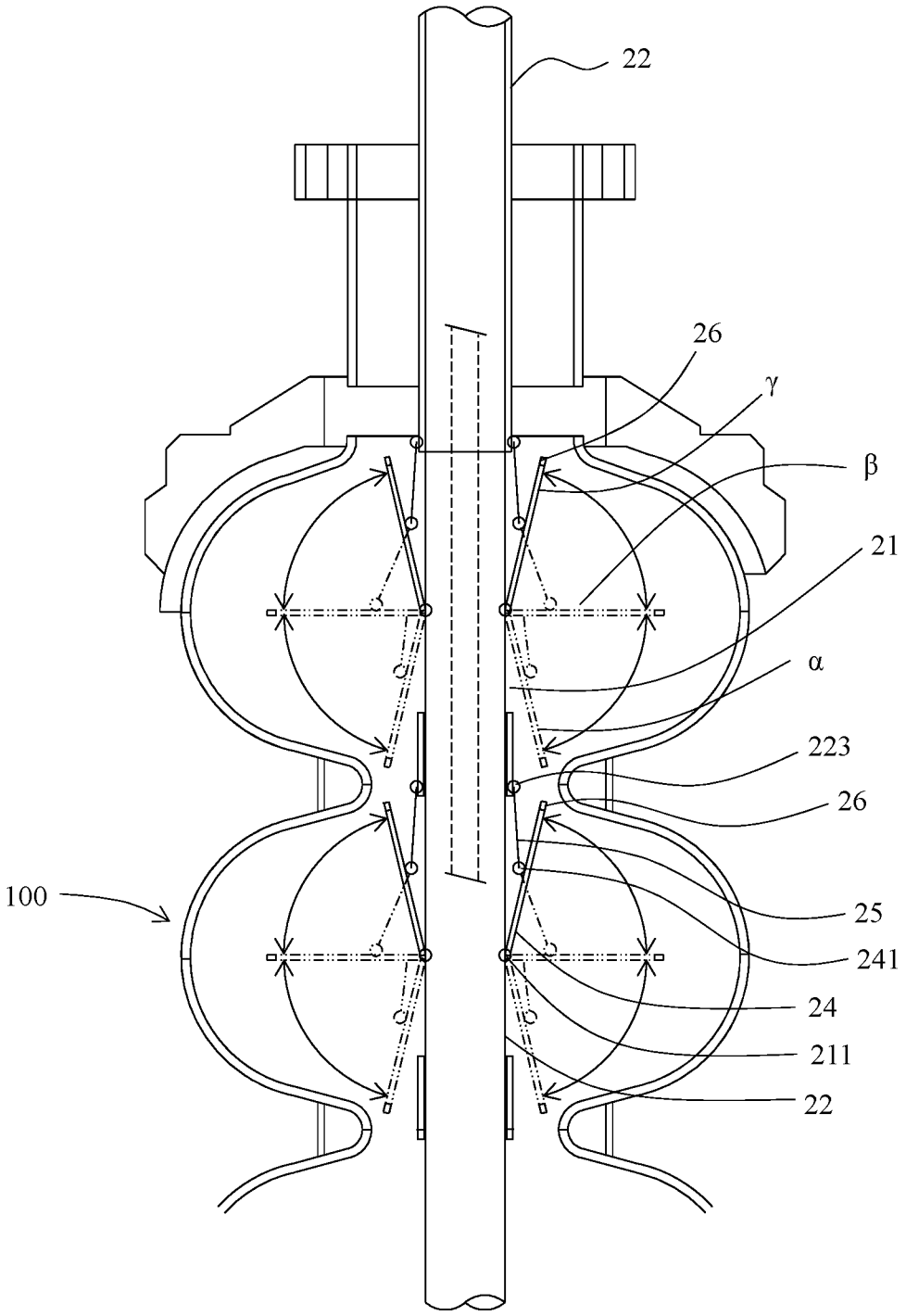
FIG. 5 is a side view showing a state of a plate vane opened by approximately 180 degree.

The above description refers to only the case where the plate vanes 24 are changed from the initial state to the horizontal state, but the plate vanes 24 in the horizontal state can be further opened by approximate 180 degree from the initial state as shown in FIG. 5.

According to such configuration, the angle between the plate vane 24 and the main shaft is changed from the most opened state (a state $\alpha$ that the outer tube is pulled down by the lowest position) to the initial state (a state $\gamma$ that the outer tube 22 is pulled up maximally) through the horizontal state (a state $\beta$), whereby it is possible to electropolish over the whole inner surface of the hollow tube 100. When the distance between the plate vane and the inner surface of the hollow tube 100 becomes uneven depending on the angle of the plate vane 24, and the polishing should be performed more uniformly in thickness, it is necessary to control the current or the processing time according to the angle. The purpose of the present invention is to remove the welded oxide or the flux of the bulge part of the hollow tube 100 as described above. When the angle of the plate vane 24 becomes the horizontal state, the polishing should be controlled by increasing the polishing degree, for example.

<Structure of Venting and Discharging Bubbles>

A large amount of bubbles like hydrogen is generated during the electropolishing, which causes to lower the quality of the polishing. In addition, when the niobium, a hollow tube material applied to the Linear Collider as described in the introduction, absorbs the hydrogen, the property as the accelerator cannot be exhibited enough.

Therefore, the inner surface of the hollow tube 100 should be configured not to be exposed to the generated bubbles as much as possible. And then, the gas venting structure described hereinafter is provided to the liquid exit room 19.

Figure 6:
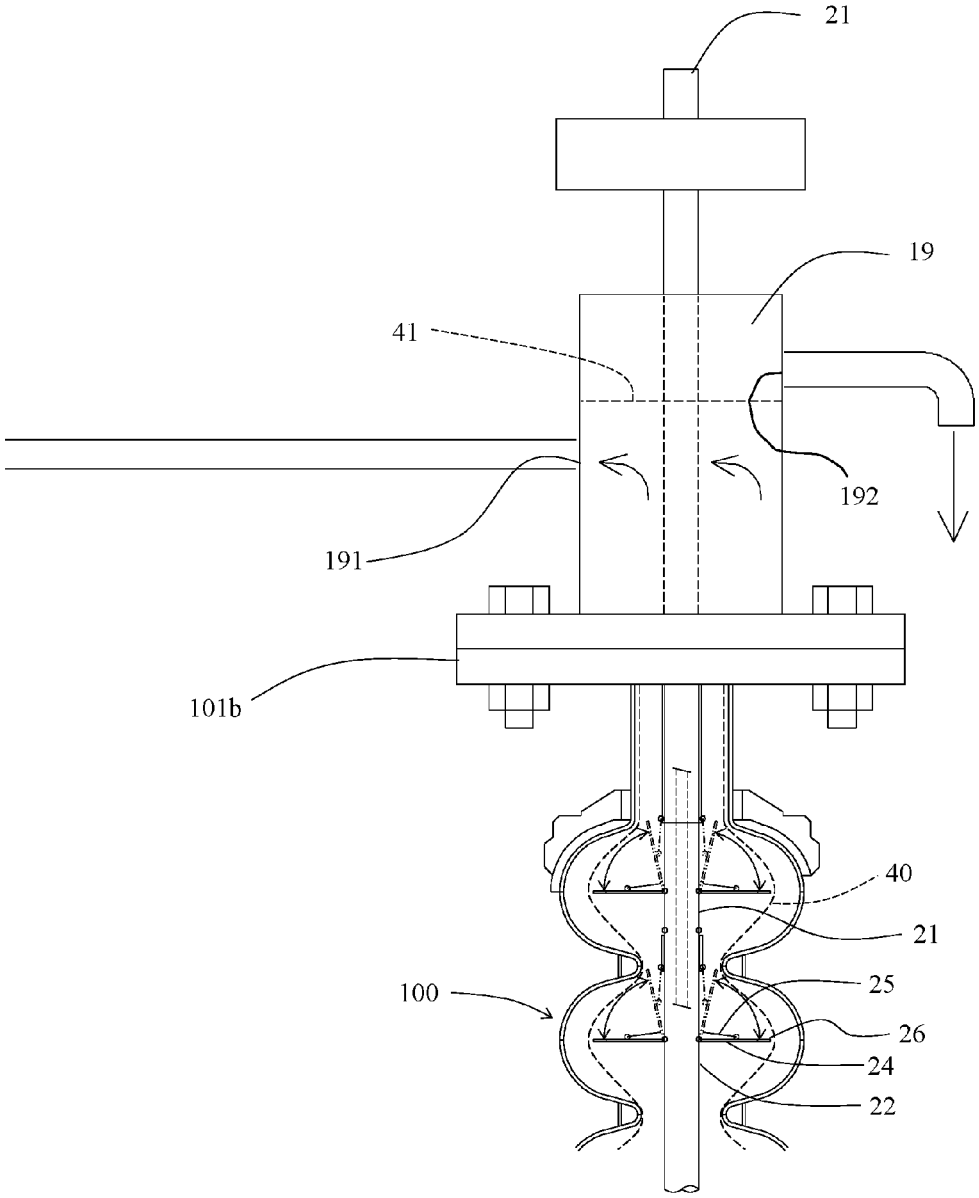
FIG. 6 shows a degassing structure.

In the above configuration, the polishing liquid circulates through the polishing liquid tank 15, the liquid entrance room 14, the hollow tube 100, the liquid exit room 19, and the polishing liquid tank 15, but the bubbles generated during the electrolysis processing collect in the liquid exit room 19. Therefore, it is configured as shown in FIG. 6 that a bubble release hole 192 is provided to a position above a liquid circulating hole 191 of the liquid exit room 19 (a position above a water line 141), and the bubbles are forced to be discharged from the bubble release hole 192. Such configuration can eliminate the bad influence by the bubbles.

In addition, it is also required to configure so that the generated bubbles do not touch the inner surface of the hollow tube 100. The rotor 200 for the electropolishing is covered over with an insulating cloth or mesh cover 40. The generated babbles are introduced to the liquid exit room 19 by opening a top of the cover 40 to the liquid exit room 19 (a bubble vent hole).

According to the above structure, it is possible to perform the polishing without having the generated bubbles touch the inner surface of the hollow tube 100. And when the rotor 200 is inserted to the hollow tube 100 in the preparation step, or when the rotor 200 is extracted from the hollow tube after the electropolishing, it is possible to avoid damaging the hollow tube 100. Needless to say, the plate vanes 24 is closed.

The other structure shown in FIG. 4 may be employed, wherein a vent hole 28 communicating the inner tube 21 and the inside of the hollow tube 100 is provided on the inner tube 21 corresponding to the window 221, and the inner tube is coupled with the liquid exit room 19 through the vent hole (not shown). Otherwise, this structure can be used together with the structure provided with the cover 40.

Figure 7:
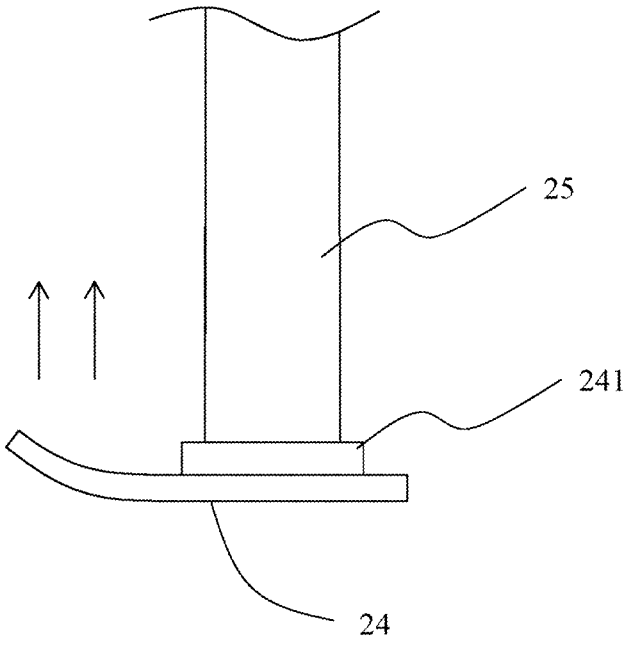
FIG. 7 shows a plate vane provided with a screw function.

The plate vane 24 rotates around the main shaft inside of the hollow tube 100 as described above, and the electropolishing is performed. No matter what the rotor has the structure with the cover 40 or not, it is effective that the function of supplying the electrolytic solution upwards together with the bubbles by means of the rotation is given to the plate vane 24. For example, it is preferred to provide the plate vane 24 with the screw function by having the downstream side of the rotation of the plate vane 24 warp upward as shown in FIG. 7.

The above description describes a case where one plate vane unit 20 is provided with a plurality of plate vanes 24. With respect to the number of the plate vanes, it is enough that one plate vane unit 20 is provided with at least one plate vane.

It is natural in the present invention that the same polishing liquid as the conventional one (for example, the hydrofluoric acid, the sulfuric acid, the polishing liquid composed of the water) is used as the polishing liquid. The thickness to be polished is 50 μm to 100 μm where the hollow tube is the high-speed accelerator. At the polishing, the voltage to be applied is about 15V, and the current to flow is approximately $20A/dm^2$.

The rotor 200 employed by the present invention can be used for not only the electropolishing of the niobium but also the electropolishing of the inner surface of the various kinds of metal tubes, and the rotor may be applied not only to the electropolishing but also to the electrolytic plating.

<Rotor 1 for the Buff-polishing>

The rotor configured as above can be diverted to the mechanical polishing like the buff-polishing without change.

Figure 8:
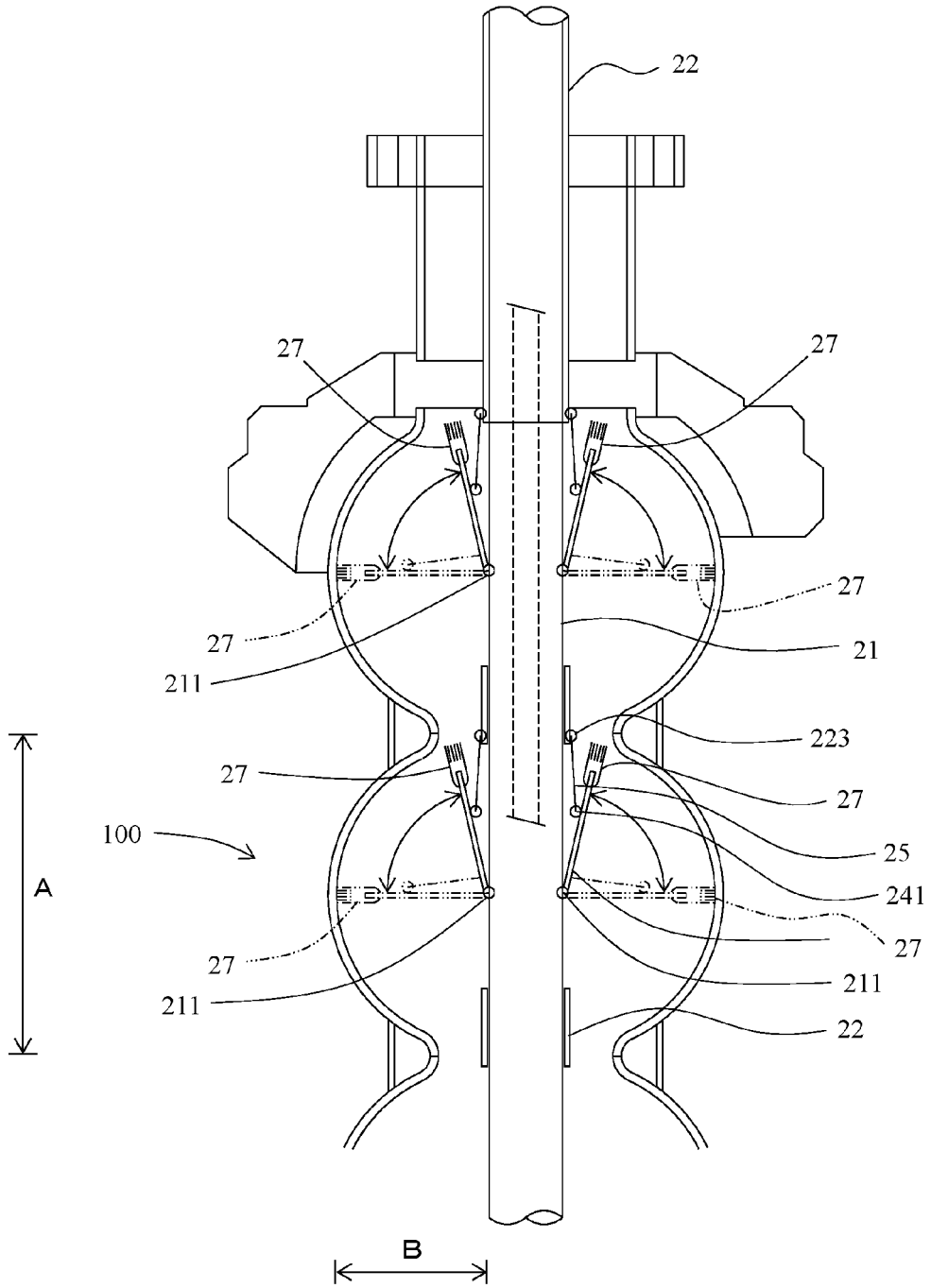
FIG. 8 is a sectional side view showing a structure of the rotor for the mechanical polishing.
Figure 9:
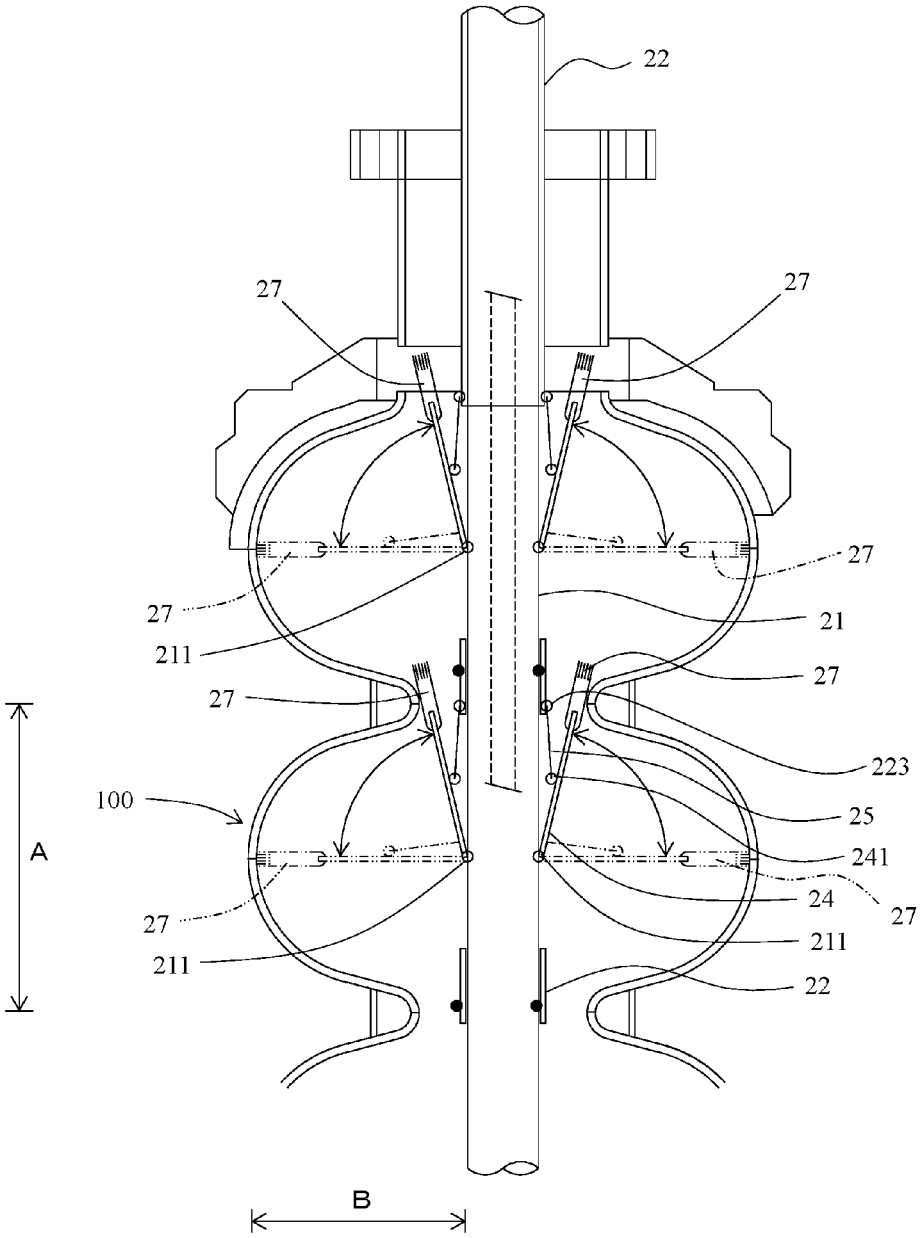
FIG. 9 is a side view showing a use state of the rotor for the mechanical polishing.

As shown in FIG. 8 and FIG. 9, the plate vane 24 is provided with a buff 27 instead of the electrode 26 at the tip of the plate vane 24. When using the above configured rotor 200, the polishing device does not require a system for circulating the electrolysis solution through the liquid entrance room 14 and the liquid exit room 19, since the polishing device does not use the electrolysis solution, but requires a driving unit 130 for rotating the plate vane 24.

Figure 10:
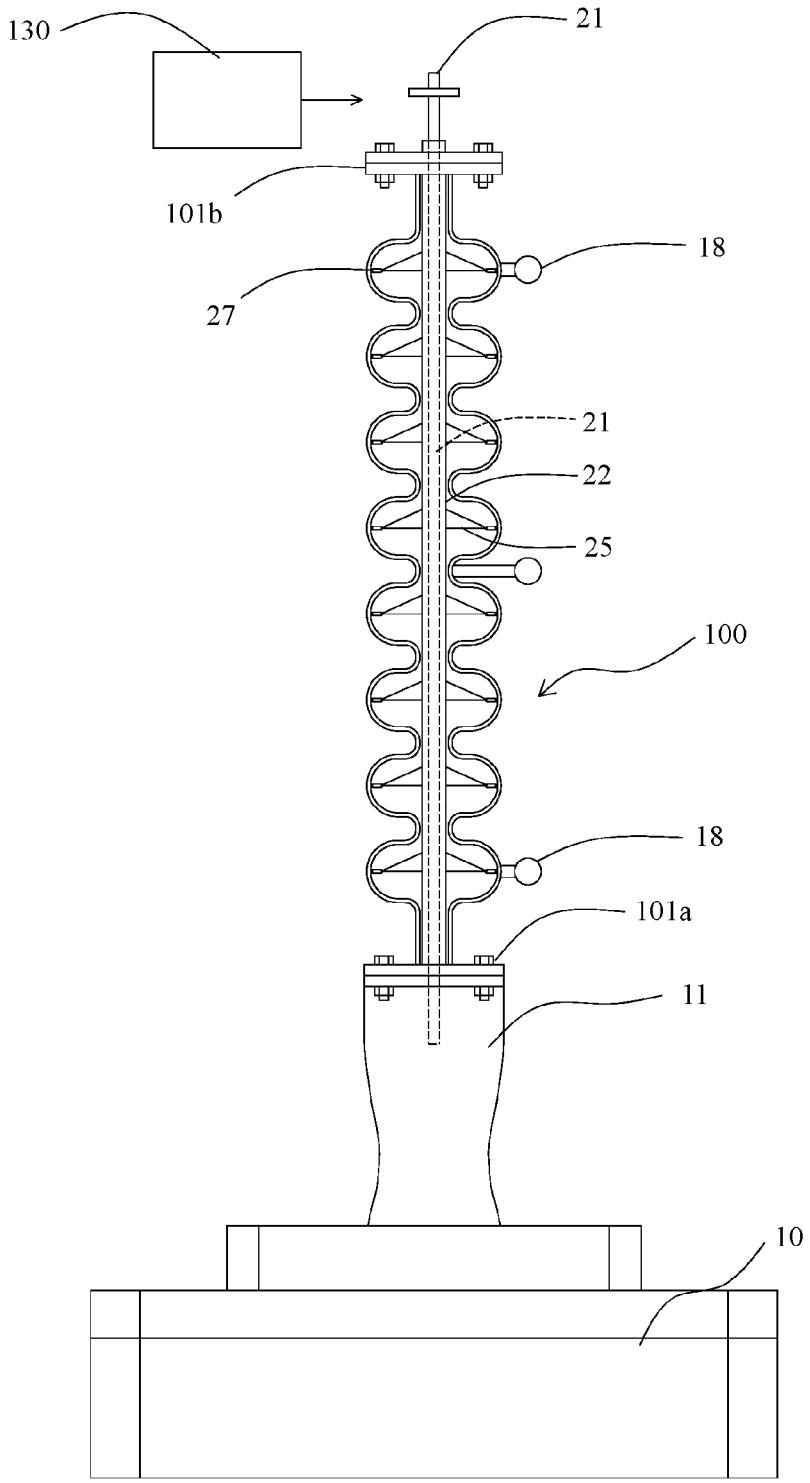
FIG. 10 is a side view showing the other use state of the rotor for the mechanical polishing.

When the polishing rotor 200 configured as above is applied to the actual polishing, the rotor in the initial state as shown in FIG. 10 is inserted to the hollow tube 100 placed on the base 10 in the same manner described in FIG. 1. While keeping the state (the operational state) that the buff 27 at the tip of the plate vane 24 is contacting with the innermost part (the welded part) of each bulge of the hollow tube by expanding the plate vane 24, the plate vane 24 is rotated.

After polishing the innermost part (the welded part) by the rotation, the polishing rotor 200 is changed to the initial state again, and extracted from the hollow tube 100.

With respect to the bulge of the hollow tube 100, when a radius B in a direction perpendicular to the main shat is less than half of a diameter A in the main shaft direction, a length merging the length of the plate vane 24 and the length of the buff 27 is made to correspond to the radius B as shown in FIG. 8, whereby the buff 27 at the tip of the plate vane 24 contacts with the innermost part of the bulge of the hollow tube 100 in the operational state. When the radius B in a direction perpendicular to the main shat is almost the same as the diameter A in the main shaft direction, if the length merging the length of the plate vane 24 and the length of the buff 27 at the tip of the plate vane 24 is formed so as to match the diameter A, the buff 27 at the tip of the plate vane 24 is projected from the bulge, as shown in FIG. 9. In this case, the rotor 200 is temporally pulled down till the auxiliary shaft 211 at the base end of the plate vane 24 reaches a position nearby the bottom of the bulge (a black circle position), and then the rotor 200 is pulled up till the auxiliary shaft 211 reaches the position at the center of the axial direction of the bulge, whereby it is possible to keep the state that the buff 27 is contacting with the innermost part of the bulge of the hollow tube 100.

As described above, the driving unit 130 rotates the rotor 200 in the state of opening the plate vane 24 in the horizontal direction, so that the buff-polishing of the inner surface of the hollow tube can be performed.

<Rotor 2 for the Buff-polishing>

Figure 11:
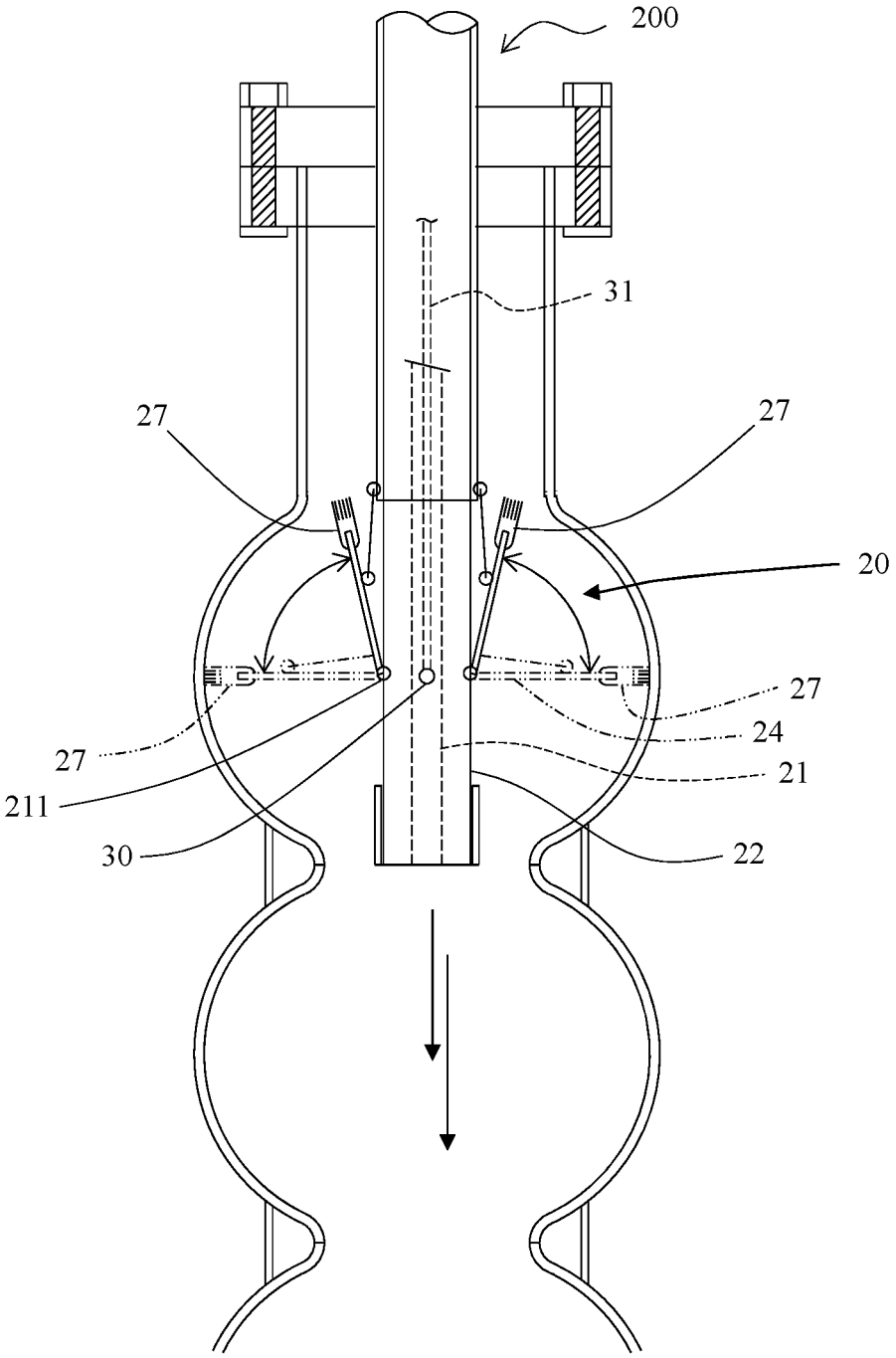
FIG. 11 is a sectional side view showing the other structure of the rotor for the mechanical polishing.

In the above description, the plurality of the plate vane units 20 is configured so as to correspond to the number and the positions of the bulges, but only one plate vane unit 20 may be sufficient as described hereinafter. As shown in FIG. 11, the rotor 200 is configured to arrange one plate vane unit nearby the lower end of the inner tube 21 and outer tube 22. In this case, the buff 27 is fixed to the tip of the plate vane 24. An endoscope 30 is fixed at the position on the inner tube 21 or the outer tube 22 corresponding to the bulge, in order to monitor the state of the polishing by means of an outer monitor from the endoscope 30 via the optical fiber 31.

In the same manner as the state shown in FIG. 10, while standing the hollow tube 100 on the base 10, the rotor for the buff-polishing configured as above is inserted in the hollow tube with keeping the initial state, so as to positioning the plate vane unit 20 at the position of the uppermost bulge. Next, by changing the plate vane unit 20 to the operational state, the buff at the tip of the plate vane 24 contacts with the innermost part of the bulge (the welded part) of the hollow tube, and the plate vane 24 is rotated. The polishing of the welded part is proceeding by the rotation, and the processing can be confirmed by a camera.

When an operator can confirmed the polishing was performed sufficiently, he stops the rotation, changes the plate vane 24 to the initial state, and pulls down the plate vane unit 20 to the position of the bulge beneath the uppermost bulge. At this position, the plate vane 24 is changed to the operational state again, and the innermost part (welded part) of the bulge is polished in the same manner as the uppermost bulge. According to repetition of these operations, it is possible to polish all the inner surface of the hollow tube.

When polishing the lowermost bulge, the plate vane 24 is changed to the initial state, and extracted from the hollow tube 100, whereby the polishing of all parts is completed.

INDUSTRIAL APPLICABILITY

As explained above, since the present invention can change from the initial state to the operational state by opening and closing the plate vane, the innermost part (the welded part) of the bulge of the hollow tube can be polished by fixing the electrode at the tip of the plate vane. In addition, the electropolishing can be performed by all over the inner surface of the hollow tube by adjusting the opening angle of the plate vane in the middle of the electrolysis processing. By fixing the buff at the tip of the plate vane instead of the electrode, the innermost part of the bulge of the hollow tube can be subjected to the buff-polishing.

As described above, the present invention is explained according to the example of the hollow tube arranged the bulges periodically in the axial direction, however, the present invention is not limited to this, it is sure that the present invention can be applied to the polishing of the inner surface of every kinds of tube, like the inner surface of the simple tube, the inner surface of the can with the bottom, and so on.

DESCRIPTION OF THE REFERENCE NUMERAL

10 Base
11 Stand
14 Liquid entrance room
19 Liquid exit room
21 Inner tube
22 Outer tube
24 Plate vane
25 Link bar
28 Vent hole
30 Endoscope
100 Hollow tube
200 Rotor

The invention claimed is:

1. A rotor for polishing an inner surface of a hollow tube comprising:

an inner tube;

an outer tube inserted slidably over an inner tube;

at least one window provided to a peripheral wall of the outer tube;

at least one plate vane arranged on the inner tube in a circumferential direction, and moving rotatably around an auxiliary shaft perpendicular to a main shaft by a base end of the plate vane fixed at a position corresponding to the window;

a link system including a link bar arranged in the main shaft direction to connect the outer tube with the plate vane, and moving the plate vane from an initial state of closing the plate vane to an operational state of opening the plate vane by relatively sliding the inner tube and the outer tube in the main shaft direction.

2. The rotor for polishing the hollow tube according to claim 1, wherein the plate vane is provided with an electrode on the tip of the plate vane and the rotor is applied to the electropolishing.

3. The rotor for polishing the hollow tube according to claim 2, wherein the operational state is a state of opening the plate vane in a direction perpendicular to the main shaft direction.

4. The rotor for polishing the hollow tube according to claim 2, wherein the operational sate is a state of moving the plate vane in a range between a state of closing the plate vane in the main shaft direction and a state of opening the plate vane to 180 degree in a direction opposite to the initial state.

5. The rotor for polishing the hollow tube according to claim 2, wherein the hollow tube is provided with a plurality of bulges periodically in an axial direction, a plate vane unit constitutes at least one plate vane corresponding to one bulge, and the rotor is provided with the same number of the plate vane units as the number of the bulges.

6. The rotor for polishing the hollow tube according to claim 2, further comprising:

an insulating mesh or cloth cover covering all over the rotor; and a bubble vent hole for discharging the bubbles generated during the polishing.

7. The rotor for polishing the hollow tube according to claim 1, wherein the plate vane is provided with a buff on the tip of the plate vane and the rotor is applied to the buff-polishing.

8. The rotor for polishing the hollow tube according to claim 7, wherein the operational sate is a state of opening the plate vane in a direction perpendicular to the main shaft direction.

9. The rotor for polishing the hollow tube according to claim 7, wherein the hollow tube is provided with a plurality of bulges periodically in an axial direction, a plate vane unit constitutes a plurality of plate vanes corresponding to one bulge, and the rotor is provided with the same number of the plate vane units as the number of the bulges.

10. The rotor for polishing the hollow tube according to claim 7, wherein the hollow tube is provided with a plurality of bulges periodically in an axial direction, a plate vane unit constitutes a plurality of plate vanes corresponding to one bulge, and the rotor is provided with one plate vane unit regardless of the number of the bulges.

* * * * *